United States Patent [19]

Robinson et al.

[11] Patent Number: 4,570,572

[45] Date of Patent: Feb. 18, 1986

[54] ELECTROGRAPHIC DEVELOPMENT APPARATUS

[75] Inventors: Kelly S. Robinson, Rochester; Richard A. Weitzel, Hilton; Arthur S. Kroll, Rochester, all of N.Y.

[73] Assignee: Eastman Kodak Company, Rochester, N.Y.

[21] Appl. No.: 717,257

[22] Filed: Mar. 28, 1985

[51] Int. Cl.[4] ..... G03G 15/09

[52] U.S. Cl. ..... 118/657; 118/69; 118/658; 355/3 DD

[58] Field of Search ..... 118/657, 658, 69; 355/3 DD

*Primary Examiner*—Bernard D. Pianalto

*Attorney, Agent, or Firm*—Warren W. Kurz

[57] ABSTRACT

An electrographic development apparatus comprises a magnetic brush applicator having cooling means for dissipating thermal energy from the developer as it is transported by the brush. Such cooling means preferably comprises means for passing a cooling fluid through the interior of the brush while in use. Alternatively, such cooling means comprises a hollow skive through which a cooling fluid is circulated.

8 Claims, 5 Drawing Figures

ELECTROGRAPHIC DEVELOPMENT APPARATUS

BACKGROUND OF THE INVENTION

1. Field of the Invention

This invention relates to the field of electrographic recording and, more particularly, to apparatus for developing electrostatic charge patterns.

2. The Prior Art

In the electrographic recording process, a latent electrostatic charge pattern borne by a recording element (e.g. a dielectric or photoconductive member) is rendered visible by the application of thermoplastic toner particles. Typically, such toner particles form part of a development mix which may also include magnetic or magentizable carrier particles to which the toner particles adhere via triboelectric forces. When such a development mix is applied to an electrostatic charge pattern, the electrostatic forces associated with the pattern act to strip the toner particles from the carrier and apply them to the charged areas of the recording element.

It is conventional in the art to apply electrographic developer to an electrostatic charge pattern with a magnetic brush applicator. Such an applicator typically comprises a cylindrical sleeve of non-magnetic material (e.g. stainless steel, plated plastics) having a magnetic field-producing core piece positioned therein. Lines of force from the magnetic core piece penetrate the non-magnetic sleeve and thereby draw the magnetically attractive development mix to the outer surface of the sleeve. As the core piece and sleeve rotate relative to one another, the developer is transported from a reservoir to a position in which it contacts the electrostatic charge pattern.

In the commonly assigned U.S. Pat. No. 4,473,029, issued to Fritz et al, there is disclosed an electrographic development system comprising a magnetic brush applicator and a developer comprising magnetically "hard" carrier particles. The brush's magnetic core is rotated at a high rate of speed (e.g. 1500 RPM) which produces rapid changes in polarity of the magnetic field at the brush's outer surface. These polarity changes cause the hard magnetic particles to continuously flip-flop, end-over-end, in attempting to align themselves with the instantaneous magnetic field. Such flip-flopping of particles acts to continuously churn the developer during transport by the brush. While this churning effect is highly desirable from the standpoint that it serves to continuously present "fresh" developer to the outermost portion of the brush nap, it does present certain difficulties, as explained below.

Not to be confused with any prior art observation, we have observed a significant increase in developer temperature in development systems of the above-mentioned type. We attribute this temperature increase, which may be as much as 40° C., to frictional heating which occurs while the developer is being transported and, hence, churned by the brush. While such a temperature increase may have little or no effect on some toners, it has been found to have a marked adverse affect on toners having relatively low glass transition temperatures, such as those used in high speed electrographic copiers. Such toners tend to become sticky or tacky when subjected to this amount of heating and, as this occurs, the development process gradually deteriorates.

The need to control developer temperature in the electrographic reproduction process has been recognized before. For example, U.S. Pat. No. 4,112,870, issued to Extra et al discloses an electrographic magnetic brush system in which the bottom of the developer reservoir is made "double-walled" to provide a cooling space through which a stream of air can be maintained. The purpose of this air stream is to conduct heat away from the reservoir and thereby maintain the developer temperature within an acceptable range. In this case, the noted increase in developer temperature was caused by the frictional heat produced by the action of mixing augers positioned at the bottom of the developer reservoir. While a double-walled reservoir may be useful in cooling developer in the vicinity of mixing augers, it would not be effective in dissipating the heat generated by the churning action on the surface of the brush.

SUMMARY OF THE INVENTION

In view of the foregoing discussion, it is an object of this invention to provide a magnetic brush apparatus in which the effects of any increase in developer temperature occurring during transport by the brush are minimized.

According to the invention, this object is achieved by the provision of a magnetic brush which includes means for cooling the developer while being transported (and agitated) by the brush. According to a preferred embodiment, means are provided for passing a cooling fluid (e.g. air) through the interior of a magnetic brush to dissipate heat from its outer surface. According to another preferred embodiment, a cooling fluid is circulated through a hollow skive bar which contacts the developer on the brush and functions to either meter the amount of developer on the brush or to remove developer from the brush following development.

The invention and its various advantages will become more apparent to those skilled in the art from the ensuing description of preferred embodiments, reference being made to the accompanying drawings.

DETAILED DESCRIPTION OF PREFERRED EMBODIMENTS

Figure 1:
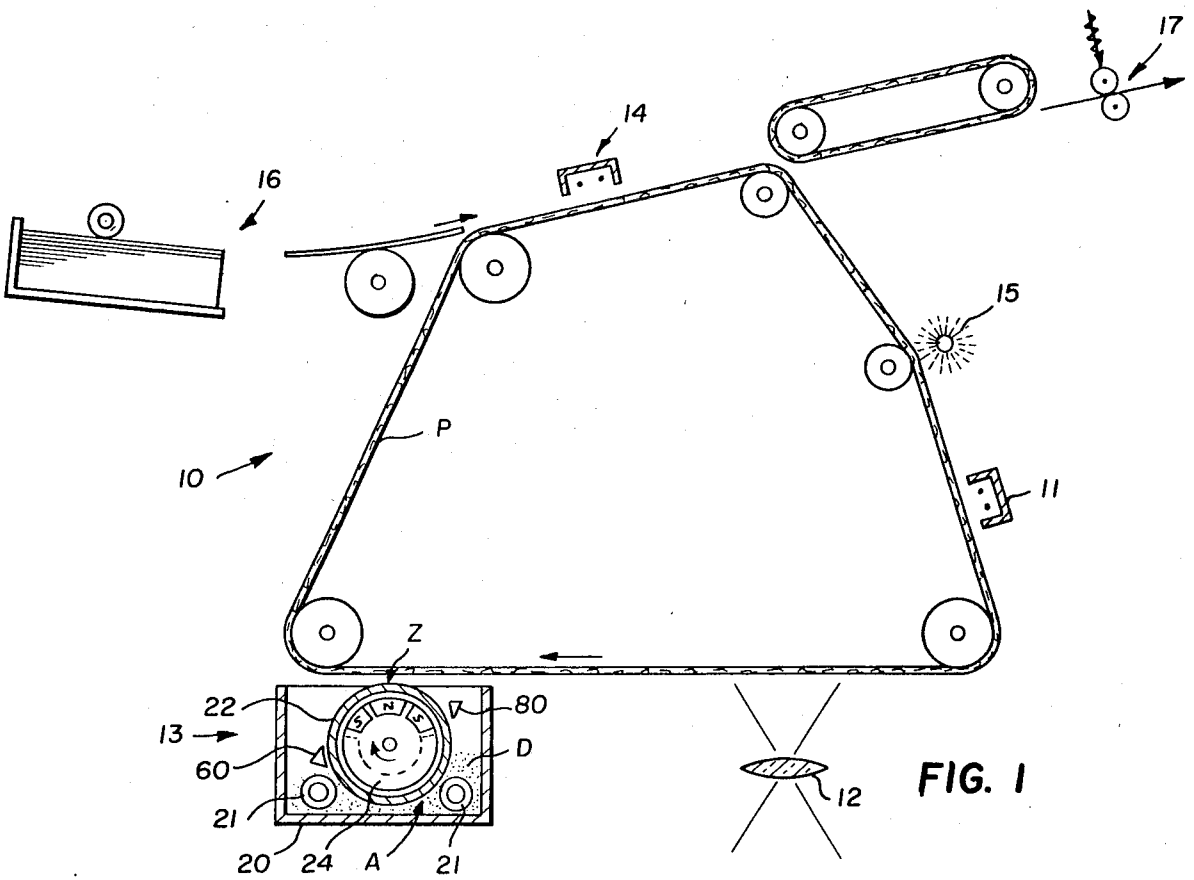
FIG. 1 is a schematic illustration of an electrophotographic copier embodying the magnetic brush development apparatus of the present invention.

Referring now to the drawings, FIG. 1 schematically illustrates a conventional electrophotographic copier 10 in which an endless photoconductive recording element P is advanced along a closed-loop path past several well-known processing stations. As the recording element passes charging station 11, a uniform electrostatic charge is applied thereto. Thereafter, the recording element is imagewise exposed to a document being copied at exposure station 12, thereby selectively dissipating the uniform charge to form a latent electrostatic image. The recording element is then advanced past a developing station 13 at which an electrographic developer is applied to the latent image to produce a visible, transferrable toner image. As the toner image arrives at a transfer station 14, a copy sheet is fed from supply 16. Owing to the effect of the transfer station, the toner image is transferred to the copy sheet, and the latter is thereafter transported to a fusing station 17 which fixes the toner image to the copy sheet.

The development station 13 basically comprises a reservoir 20 for containing a magnetizable electrographic developer D, a pair of mixing augers 21 and a magnetic brush assembly A for applying the developer to the recording element. Developer D may be of the two-component type mentioned above, or it may be of the single component type in which case the toner per se is magnetically attractive.

Figure 3:
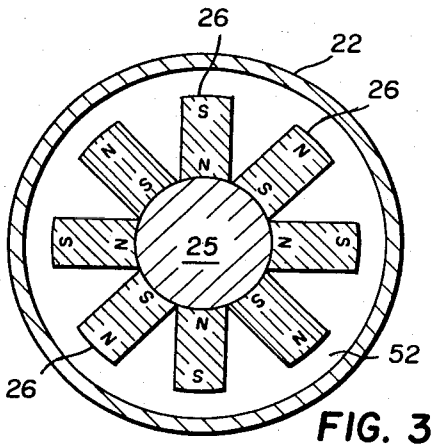
FIGS. 3 and 4 are cross-sectional views of the apparatus shown in FIG. 2 taken along the section lines 3—3 and 4—4, respectively.
Figure 2:
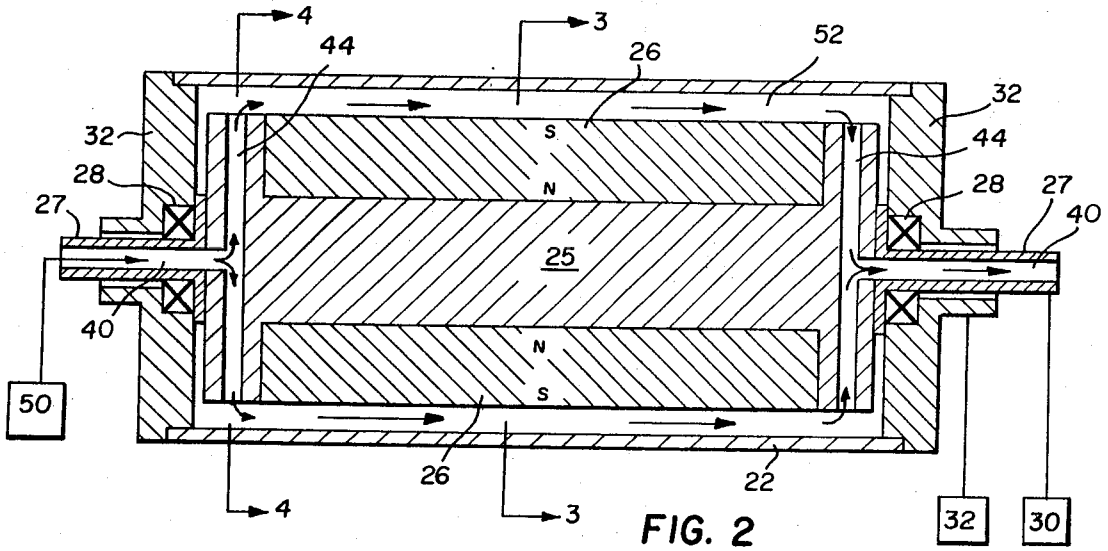
FIG. 2 is a cross-sectional view of a magnetic development brush structured in accordance with the preferred embodiment.
Figure 4:
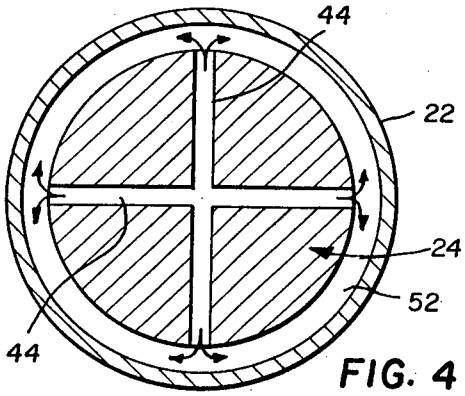

As better shown in FIGS. 2–4, the brush assembly comprises a non-magnetic (e.g. stainless steel or metal-plated plastic) cylindrical sleeve 22 having a magnetic core 24 positioned therein. Magnetic core 24 comprises a non-magnetic, generally cylindrical housing 25 having a plurality of elongated magnetic strips 26 located around its periphery. The magnetic strips are arranged to produce magnetic fields which alternate, north-south-north-etc., in polarity around the circumference of the housing. A pair of shafts 27 extend outwardly from opposite ends of the core housing 25, each drive shaft being journalled for rotation within the inner race of a bearing 28. Conventional drive means 30 are provided for rotatably driving the magnetic core via one of the shafts 27. Bearings 28 are supported by the two end caps 32 which also serve to support the cylindrical sleeve 22 in a position spaced from and concentric with the core housing 25. End caps 32 and sleeve 22 collectively define an enclosed chamber in which core 24 is rotatably supported. Optionally, the end caps 32 are journalled for rotation about an outer race of bearings 28, in which case drive means 32 may be provided for rotatably driving the cylindrical sleeve 22, via one of the end caps 32, for movement about the magnetic core.

Magnetic brush assemblies of the type heretofore described are well known in the art and, as mentioned above, serve to transport a magnetically attractive developer from a reservoir to a development zone Z (FIG. 1) at which the developer is used to render a latent electrostatic image visible. As the magnetic core rotates relative to its outer sleeve, especially at rates exceeding 500 RPM, the magnetizable developer is both transported and churned on the outer surface of the sleeve. In using the magnetic brush of this type with a magnetic developer of the type disclosed in the aforementioned U.S. Pat. No. 4,473,029, we have observed an increase in temperature of the developer by as much as 40° C. It is suspected that this temperature increase is attributable to frictional heating as the developer particles flip, end for end, in continuously trying to become aligned with the rapidly changing magnetic field. While this increase in temperature has little or no effect with developers having a relatively high melting point, such temperature increase can produce a deterioration in print quality when using developers having a melting point closer to ambient, such as those developers used in high speed copiers wherein the fusing must be accomplished in a comparatively short time interval. The effect of this increase in developer temperature is that the particles (e.g. the toner in a two-component developer mix) tend to become sticky and adhere to one another, making it difficult to apply desired quantities to the recording element to effect development.

Now in accordance with the present invention, means are provided for cooling the developer while being transported by the development brush. According to a preferred embodiment shown in FIGS. 2–4, means are provided for circulating a cooling fluid, e.g. air, through the interior of the development brush during operation thereof. Specifically, conduits 40 are formed in each of the drive shafts 27, such conduits communicating with radially extending ducts 44 formed in each end of housing 25. A source of positive air pressure 50 is connected to one end of drive shaft 27 and air is thereby caused to flow in the direction of the arrows shown in FIGS. 2 and 4. As shown, air enters through the conduit formed in one drive shaft 27, circulates in the space 52 separating the magnetic core from the cylindrical sleeve, and exits through the conduit formed in the drive shaft at the opposite end of the brush. This circulation of air serves to conduct heat away from the cylindrical sleeve which itself becomes heated by the developer on its outer surface.

Figure 5:
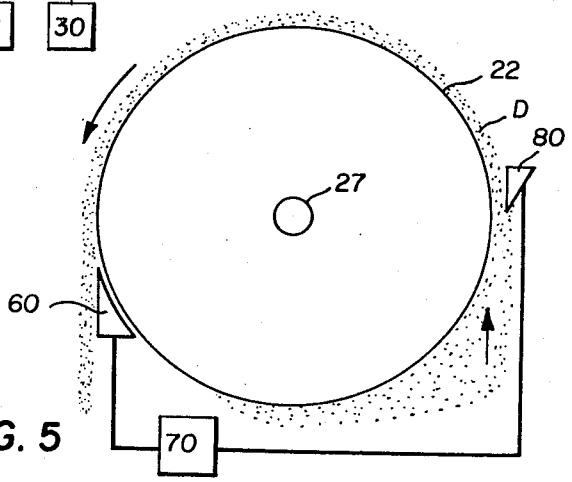
FIG. 5 is an enlarged sectional view of a portion of the FIG. 1 apparatus showing another embodiment of the invention.

Referring to FIG. 5, there is shown an alternative technique for dissipating thermal energy from the developed during transport by the brush. There, a hollow stripping skive 60 is coupled to a fan 70 or the like which acts to circulate cooling air through the skive as it removes developer from the surface of sleeve 22 following development. Additionally, a similarly shaped feed skive 80, used to control the thickness of the brush nap may be coupled to the fan to lower the developer temperature as it is transported to the development zone.

The invention has been described in detail with particular reference to preferred embodiments thereof, but it will be understood that variations and modifications can be effected within the spirit and scope of the invention.

What is claimed is:

1. In an electrographic development apparatus for applying a magnetically attractable developer to an electrostatic charge pattern on a support, said apparatus comprising a hollow non-magnetic sleeve, a magnetic field-producing means disposed within said sleeve for magnetically attracting developer to the sleeve's outer surface, and means for imparting relative motion between said sleeve and said magnetic field-producing means to transport developer toward and away from a development zone at which is applied to a charge pattern to effect development thereof, the improvement comprising means for cooling the developer whilst being transported by said apparatus.

2. The apparatus as defined by claim 1 wherein said cooling means comprises means for conducting thermal energy away from the transported developer.

3. The apparatus as defined by claim 1 wherein said cooling means comprises means for reducing the temperature of the interior of said sleeve.

4. The apparatus as defined by claim 3, wherein said temperature-reducing means comprises means for introducing a cooling fluid into the interior of said sleeve.

5. The apparatus as defined by claim 1 wherein said cooling means comprises means for passing a cooling fluid through said sleeve.

6. The apparatus as defined by claim 5 wherein said cooling fluid is a gas.

7. The apparatus as defined by claim 1 wherein said cooling means copmrises an air-cooled skive bar and means for contacting the transported developer with said skive bar.

8. An electrographic development apparatus for applying a magnetically attractable developer to an electrostatic charge pattern on a support, said apparatus comprising (a) a non-magnetic cylindrical sleeve supported by a pair of end caps, said sleeve and end caps collectively defining an enclosed chamber, (b) a magnetic core rotatably supported within said chamber on a pair of hollow shafts extending from opposite ends of said core, said shafts extending outwardly from said chamber through said end caps, and (c) means for introducing a cooling fluid into said chamber through one of said hollow shafts and for removing such fluid from said chamber through the other of said hollow shafts.

* * * * *